US005275412A

United States Patent [19]

Innes

[11] Patent Number: 5,275,412

[45] Date of Patent: Jan. 4, 1994

[54] GOLF PUTTING CLUB

[76] Inventor: Stuart W. Innes, 2620 Albert Street, Regina, Saskatchewan, Canada, S4P 2V9

[21] Appl. No.: 873,297

[22] Filed: Apr. 23, 1992

[51] Int. Cl.[5] ..... A63B 69/36; A63B 53/04

[52] U.S. Cl. ..... 273/164.1; 273/171; 273/167 F

[58] Field of Search ..... 273/167R-167K, 169, 171, 172, 173, 163R, 164.1, 80A, 80.2, 80C

[56] References Cited

U.S. PATENT DOCUMENTS

| | | | |
|---|---|---|---|
| D. 245,932 | 9/1977 | Lowry | 273/167 J |
| D. 248,181 | 6/1978 | Cervantes | 273/164 |
| 3,319,962 | 5/1967 | Summers | 273/167 G |
| 4,265,451 | 5/1981 | Bernhardt | 273/167 G |
| 4,325,553 | 4/1982 | Taylor | 273/167 F |
| 4,519,612 | 5/1985 | Tsao | 273/167 A |
| 4,702,477 | 10/1987 | Solomon | 273/169 |
| 4,832,340 | 5/1989 | Pickering | 273/80.2 |
| 4,898,387 | 2/1990 | Finney | 273/167 F |
| 4,986,544 | 1/1991 | Benson | 273/164 |
| 5,060,950 | 10/1991 | Finney | 273/169 |

*Primary Examiner*—Mark S. Graham
*Assistant Examiner*—Steven B. Wong

[57] ABSTRACT

A golf ball putter having a golf club assembly which includes a vertical member having a planar ball-striking surface integrally united with a horizontal sole member at substantially a right angle, a heel and toe balancing weight mounted on the rearward surface of the vertical member near the heel, a horizontal sight connected to the vertical member and supported by a vertical upright connected to the horizontal sole member and weight receiving apertures, included in the event the user prefers a personal "feel" to the putter, but the added weights shall not disturb the balance provided by the heel and toe balancing weight. The golf club assembly is controlled by a manipulating assembly including a hosel attached to an upper surface of the horizontal shoe member rearwardly of the center of gravity of the golf club assembly, a shaft is connected to the hosel and a hand grip is connected to the shaft.

16 Claims, 2 Drawing Sheets

GOLF PUTTING CLUB

This invention relates to golf ball putters and in particular to putters where the shaft axis is effectively located rearwardly of the center of gravity of the club head assembly.

BACKGROUND OF THE INVENTION

Putting the golf ball into the hole or cup is an integral part of the game of golf and therefore a great deal of time and money has been spent on innovations to make the best putter. Some of the innovations appear to focus on the psychological aspect while others have a scientific basis and it is these that are more likely to provide improved performance on the part of individual golfers. While both alignment and force may be conscious acts of the golfer the aid to accurate sustained alignment and an improved potential for a true pendulum type motion are provided herein. Research in this area has revealed that when a pivotal putter shaft in a vertical position is attached to a putter head assembly at a point directly behind and rearward of the center of gravity of the putter head assembly the assembly will gravitate toward a point even with the pivot point. This initial tendency of the clubhead assembly to move rearward should facilitate accuracy for the duration of the backswing and the subsequent reversal in tendency to pull forward of the shaft, not only facilitates the downswing but greatly assists in overcoming the obvious disadvantage of rearweighted putters commonly found today by applying a predictable and accurate force toward a square face alignment position for the latter part of the backswing and for the duration of the downswing.

A search of the prior art has revealed U.S. Pat. Nos. 4,265,451, 4,325,553 and 4,898,387. U.S. Pat. No. "451" reveals a neck member above the club head which includes a heavy wedge-shaped portion extending forward of the ball-striking surface in the direction of desired golf ball travel. This configuration is deemed to pull as well as push the club head through the stroke. This club differs from applicants in that this device has its center of gravity in front of the ball striking surface while applicants device has its center of gravity rearwardly of the ball striking surface. U.S. Pat. No. "553" is designed and balanced so that the bulk of the effective mass of the putter is as far as possible from the center of the striking face while applicants device has its effective mass distributed in an obvious and even manner relative only to the one balancing weight and the hosel. U.S. Pat. No. "387" is directed to a putter club head having a maximum moment of inertia about the vertical axis of rotation at the center of mass between the heel and toe to resist twisting forces while applicants device operates effectively without massive weight placement producing a high moment of inertia due to applicants shaft attachment being directly rearward of the center of gravity of the club head assembly.

SUMMARY OF THE INVENTION

It is desirable in golf putting to be able to move a golf ball with the required momentum in a required direction. To achieve these results one embodiment of the present invention comprises a club head assembly including a vertical oblong plate-like member for striking the ball, a horizontal oblong plate-like member fixed to the vertical member substantially at a right angle, a balancing weight attached to the vertical member, a horizontal sighting means including a sight and sight support connected together and to the vertical member and horizontal member respectively, weight receiving apertures to receive small weights in the horizontal member when deemed appropriate to provide a slightly different "personal feel" for the individual golfer and manipulating means attached to the club head assembly rearwardly of its center of gravity.

It is a principle object of the present invention to provide a scientifically designed putter of such character that will provide the potential for consistently propelling a golf ball straighter and with a lesser degree of concious physical control on the part of the golfer than any previous putter due to the location of the manipulating means.

It is still a further object of the present invention to provide a balanced club head assembly for ease of manipulation of the putter.

It is yet another object of this invention to provide a uniquely effective two groove three space horizontal sighting means to ease accurate alignment.

It is still a further object of this invention to provide weight receiving apertures for improving the "feel" of the putter as desired by the individual golfer.

These and other objects of the present invention will become readily apparent as the following description is read in conjunction with the accompanying drawings wherein like reference numerals indicate like elements throughout the several views.

DETAILED DESCRIPTION OF INVENTION

Figure 1:
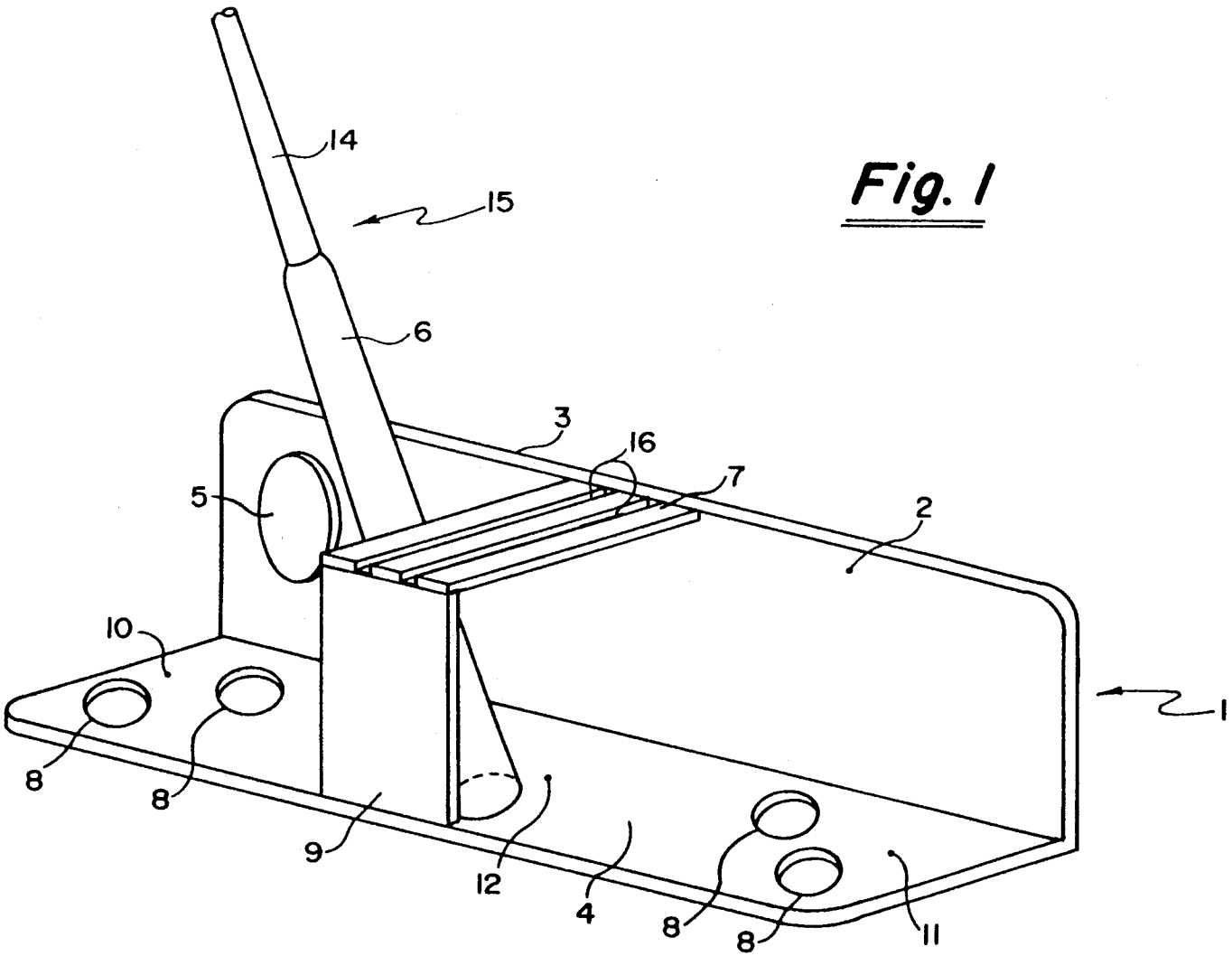
FIG. 1 is an isometric view of the main embodiment of the present invention.

Referring now to FIG. 1 we have a club head assembly 1 shown in an isometric view. The assembly 1 is formed of a club head 2 which includes an oblong vertical plate-like member 3 and an oblong horizontal plate-like member or sole 4 joined together to form an angle iron with an included angle of preferably 90° however if "loft" is desired the angle may be somewhat less than 90°, a balancing weight 5 attached to the vertical member 3, a sighting means formed of a sight 7 and sight support 9 and weight receiving apertures 8 formed in the horizontal plate-like members. To the assembly 1 is attached a manipulating means 15 which includes a hosel 6, a shaft 14 and a hand grip (not shown).

The vertical plate-like striking member 3 of club head 2 is normally formed of an oblong metal plate that has a planar forward face containing a "sweet spot" or desirable ball striking area. The horizontal oblong plate-like member or sole 4 is integrally united with vertical member 3 so that it is rearwardly thereof. The horizontal member or sole 4 is normally formed of metal or the like, it has an upper and a lower surface and is considered to be divided into three areas, the central or intermediate portion 12 flanked by a heel portion 10 and a toe portion 11. Each heel portion 10 and toe portion 11 can contain 1 or more weight receiving apertures 8, these apertures 8 with selected adaptable weights may be used to adjust the "feel" of the club to the user. Any weights added should not unbalance the club assembly 1 which has heel and toe balance provided by a balancing weight 5 which is normally a metal such as iron or lead and which is attached to the rearward side of the vertical member 3 in the vicinity of the heel portion 10 of horizontal or sole member 4.

The sighting means has a horizontal member 7 attached to the top of vertical striking member 3 from a point directly forward of the center of gravity of the club assembly 1 to a point directly rearward of the center of gravity of the club assembly 1. The horizontal member 7 is supported by a vertical support 9 attached at its lower end to the sole or horizontal member 4 and at its upper end to horizontal member 7. The horizontal member 7 shall have two sight grooves 16 separated by a space equal to the size of the space between the grooves and the edges of the horizontal member 7.

Manipulating means 15 having a proximal and distal end includes a hosel 6 at its proximal end which is attached to the upper surface of sole or horizontal member 4 substantially or directly rearward of the center of gravity of the club head assembly 1. A shaft 14 is normally coaxially mounted in the hosel 6 with a hand grip (not shown) at the distal end.

Figure 2:
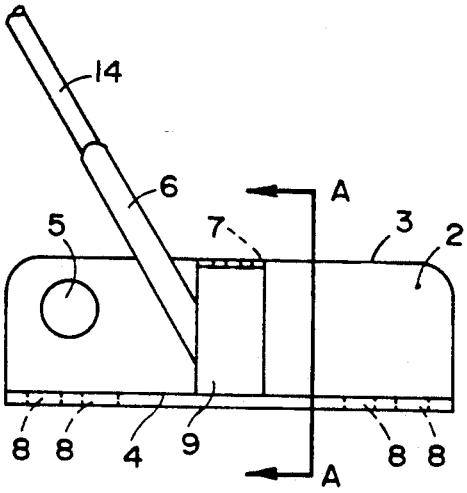
FIG. 2 is a rear elevation of the main embodiment of the present invention.

Now looking at FIG. 2 we have a rear elevation showing the same club head assembly 1 with a cutting plane A—A at approximately the area of contact of the toe portion 11 and the intermediate portion 12. Of note here is the planar surface of the sole or horizontal member 4.

Figure 3:
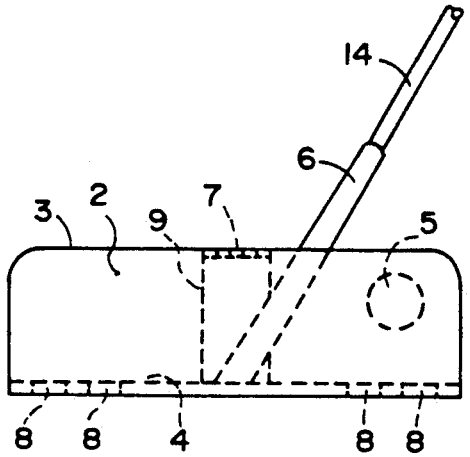
FIG. 3 is a front elevation of the main embodiment of the present invention.

Now looking at FIG. 3 we have a front elevation showing the planar face of the vertical striking member 3 with the remaining elements hidden except for a portion of the manipulating means 15.

Figure 4:
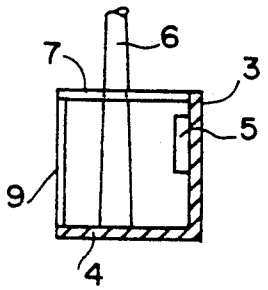
FIG. 4 is a cross section of FIG. 2 taken along the cutting plane A—A of FIG. 2.
Figure 5:
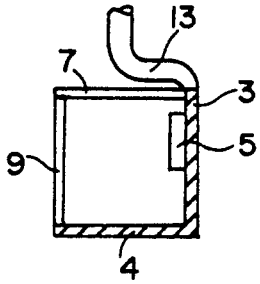
FIG. 5 is a cross section the same as FIG. 4 but is an embodiment with an offset hosel.

Reference now being made to FIGS. 4 and 5, FIG. 4 reveals the elements as seen in cutting plant A—A which shows the hosel 6 as being attached to the upper surface of horizontal or sole member 4. FIG. 5 shows how the hosel 6 can be attached to the vertical member 3 forwardly of the center of gravity of the club head assembly 1 and offset to a point rearwardly of the center of gravity of club head assembly 1.

Figure 6:
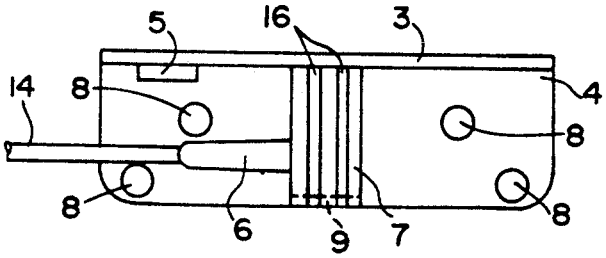
FIG. 6 is a plan view of the main embodiment of the present invention.

Referring now to FIG. 6 there is illustrated a plan view of the embodiment of FIG. 1 showing the upright striking member 3 with its obvious planar face attached to the horizontal member or sole 4 at right angles. The horizontal member or sole 4 has the weight receivable apertures 8 formed therein on the heel and toe portions. The balancing weight 5 is shown attached to the rearward surface of the upright striking member 3. The sighting means are again shown including the horizontal sight 7 with sighting grooves 16 and vertical sight support 9. The manipulating means including hosel 6 and shaft 14 with the hand grip at the distal end not being shown. The hosel 6 being attached to the upper surface of the horizontal member or sole 4.

Various modifications such as size, shape and arrangement of components may be made without departing from the spirit and scope of the invention. The accompanying specification shall be interpreted as illustrative only and limited only by the scope of the invention as defined in the following claims.

What I claim is:

1. A golf putter club comprising a manipulating means having a proximal and a distal end, a hand grip included at said distal end, a club head, a hosel connected to said club head, said proximal end of said manipulating means including said hosel, said club head including a striking plate having a forward facing ball striking surface and a rearwardly facing surface, and a sole plate having an upper surface and a lower surface intersecting and joined to said striking plate at a line of intersection to form an angle therewith, said sole plate having a rearward edge furthest from and parallel to said line of intersection, said sole plate having an intermediate portion flanked by a heel portion and a toe portion, said heel portion and said toe portion including weight receiving apertures therein, weights placed in said weight receiving apertures, a sight support extending upwardly from said upper surface at said rearward edge in the intermediate portion of said sole plate, a sight connected to said sight support and to said striking plate and being in a plane parallel to said sole plate, a balancing weight attached to the rearwardly facing surface of said striking plate in the vicinity of said sole plate heel portion, said striking plate, said sole plate, said balancing weight, said sight and said sight support forming a club head assembly, said hosel being connected to said upper surface of said sole plate directly rearwardly of the center of gravity of said club head assembly.

2. A golf putter club as claimed in claim 1 wherein said hosel and said hand grip are coaxial.

3. A golf putter club as claimed in claim 2 wherein said angle of intersection of said striking plate and said sole plate is between 85° and 90° thereby providing loft and wherein said manipulating means is parallel to a vertical plane containing a forward most edge of said ball striking surface.

4. A golf putter club as claimed in claim 2 wherein said manipulating means is in a plane parallel to a vertical plane containing said ball striking surface.

5. A golf putter club as claimed in claim 4 wherein said angle of intersection of said striking plate and said sole plate is 90°.

6. A golf putter club as claimed in claim 5 wherein said ball striking surface and the lower surface of said sole plate are planar.

7. A golf putter club as claimed in claim 5 wherein said sight extends from a point forward of the center of gravity of said club head assembly to a point rearward of the center of gravity of said club head assembly.

8. A golf ball putter club comprising in combination, a putter head for striking a golf ball including a forward vertical plate-like member, a horizontal rearward member attached thereto, said forward vertical plate-like member having a ball striking surface and an inner surface formed of two adjacent end surfaces, one of said two adjacent end surfaces being planar, a sole balancing weight attached to the other of said two adjacent end surfaces, manipulating means having a proximal end, a distal gripping end and a single rectilinear axis beginning at said distal gripping end, sighting means having a horizontal sight attached to said forward vertical member, said proximal end of manipulating means being attached to said putter head in a position such as to cause said forward vertical member to gravitate to a level balanced downward facing position and said horizontal rearward member to gravitate to a level balanced vertical position when said single rectilinear axis is in a horizontal freely rotatable position.

9. A golf ball putter club as claimed in claim 8 wherein said putter head, said balancing means and said sighting means forms a putter head assembly and wherein said proximal end of said manipulating means is attached to said forward vertical plate-like member with said manipulating means single rectilinear axis offset rearwardly of the center of gravity of said putter head assembly.

10. A golf ball putter club as claimed in claim 8 wherein said putter head, said balancing means and said sighting means form a putter head assembly and wherein said proximal end of said manipulating means is attached to said horizontal rearward member with said manipulating means single rectilinear axis passing through a point directly rearwardly of the center of gravity of said putter head assembly.

11. A golf ball putter club as claimed in claim 10 wherein said forward vertical plate-like member includes a planar ball striking surface and said horizontal rearward member includes a planar lowermost surface.

12. A golf ball putter club as claimed in claim 11 wherein said horizontal sighting means extends from a point directly forward of the center of gravity of said putter head assembly to a point directly rearward of the center of gravity of said putter head assembly and shall include two grooves and two edges and wherein said two grooves are separated by a space equal to each space between each of said edges and the nearest one of said two grooves and wherein said manipulating means single rectilinear axis shall lie in a plane parallel to a plane containing said planar ball striking surface.

13. A golf putter club comprising in combination, ball striking means including two oblong intersecting members each having a longitudinal axis, said two oblong intersecting members are joined at a line of intersection parallel to said longitudinal axis, manipulating means having a single rectilinear axis attached to a first of said two oblong intersecting members, a second of said two oblong intersecting members formed completely of a forward planar ball striking surface and a rearward planar surface formed of two adjacent planar end surfaces, a sole balancing weight mounted on one of said two rearward planar end surfaces, sighting means attached to said second of said two oblong members, said ball striking means, said balancing weight and said sighting means form a putter head assembly, said manipulating means being attached to said first oblong member so that its single rectilinear axis passes through a point directly rearwardly of the center of gravity of said golf putter head assembly, thereby creating the potential for a predictable gravitational movement of said putter head assembly in a rearward direction and further creating the potential for the predictable reversal in motion expected of a pendulum once in motion.

14. A golf putter club as claimed in claim 13 wherein said two intersecting oblong members intersect to 90° to one another and wherein said manipulating means is slopingly and permanently attached to said first oblong intersecting members at an angle of between 70° and 80°.

15. A golf putter club as claimed in claim 14 wherein said two intersecting oblong members intersect at an angle less than 90° and greater than 85° and wherein said manipulating means includes a hosel and a shaft coaxially joined.

16. A golf putter club as claimed in claim 15 wherein said first intersecting oblong member is formed of an intermediate portion flanked by a heel portion in the direction of slope of said manipulating means and a toe portion.

* * * * *